US006843722B2

(12) United States Patent
Webb

(10) Patent No.: US 6,843,722 B2
(45) Date of Patent: Jan. 18, 2005

(54) GAMING DEVICE HAVING A SELECTION-TYPE BONUS GAME THAT ACTIVATES A MECHANICAL DEVICE

(75) Inventor: Bayard S. Webb, Sparks, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 10/459,755

(22) Filed: Jun. 12, 2003

(65) Prior Publication Data

US 2003/0199311 A1 Oct. 23, 2003

Related U.S. Application Data

(63) Continuation of application No. 09/960,788, filed on Sep. 21, 2001, now Pat. No. 6,582,307.

(51) Int. Cl.[7] ..... A63F 9/24

(52) U.S. Cl. ..... 463/16; 463/20; 463/22; 463/25; 273/142 R

(58) Field of Search ..... 463/20, 22, 25; 273/142 R, 143 R

(56) References Cited

U.S. PATENT DOCUMENTS 1,912,992 A * 6/1933 Mills ..... 194/295
4,618,150 A 10/1986 Kimura
4,624,459 A 11/1986 Kaufman (List continued on next page.)

FOREIGN PATENT DOCUMENTS

EP 0874337 A1 10/1998
EP 0945837 A2 9/1999
EP 0984409 A2 3/2000
WO WO 98/14251 * 4/1998 ..... A63F/9/24

OTHER PUBLICATIONS

Mayan Wheel of Gold Article written by Strictly Slots, published prior to 2001.
Instant Slotto article written by Strictly Slots, published Apr. 2001.
Jackpot Party Brochures and Articles written by WMS Gaming, Inc., published 1998.
The Price is Right—Showcase Showdown written by IGT, published date not known.
Pink Panther Advertisement and Article written by IGT, published 2000.
Wheel of Fortune Advertisement written by IGT, published in 1999.
Frog Prince Article written by Strictly Slots, published in Jun. 2001.
Frog Prince Advertisements written by IGT, published in 2001.
Gold Fever Game Description written by Atronic GmbH, available prior to 2001, printed Mar. 12, 2002.

* cited by examiner

*Primary Examiner*—Jessica Harrison
*Assistant Examiner*—Corbett B Coburn
(74) *Attorney, Agent, or Firm*—Bell, Boyd & Lloyd LLC

(57) ABSTRACT

A gaming device having a bonus game wherein a mechanical device activates immediately after a player picking a selection having a terminator which ends a selection portion of the bonus game. The bonus game provides a player with a number of masked selections displayed on a display device. Each selection has an associated award and at least one selection has an associated terminator. The game enables the player to pick selections and accumulate a preliminary bonus award until picking a selection having a terminator. When the player picks a selection revealing a terminator, the processor immediately thereafter activates the mechanical device and after a period of time causes the mechanical device to display a modifier to the player which modifies the preliminary bonus award, thus determining the player's final bonus award.

53 Claims, 8 Drawing Sheets

U.S. PATENT DOCUMENTS 4,695,053 A 9/1987 Vazquez, Jr. et al.
5,259,616 A 11/1993 Bergmann
5,449,173 A 9/1995 Thomas et al.
5,560,603 A 10/1996 Seelig et al.
5,664,998 A 9/1997 Seelig et al.
5,766,074 A 6/1998 Cannon et al.
5,769,716 A 6/1998 Saffari et al.
5,779,544 A 7/1998 Seelig et al.
5,788,573 A 8/1998 Baerlocher et al.
5,823,874 A 10/1998 Adams
5,848,932 A 12/1998 Adams
5,851,148 A 12/1998 Brune et al.
5,855,514 A * 1/1999 Kamille ..... 463/17
5,882,261 A 3/1999 Adams
5,890,962 A 4/1999 Takemoto
5,911,418 A 6/1999 Adams
5,919,088 A 7/1999 Weiss
5,947,820 A 9/1999 Morro et al.
5,951,397 A 9/1999 Dickinson
5,980,384 A 11/1999 Barrie
5,997,400 A 12/1999 Seelig et al.
6,004,207 A 12/1999 Wilson, Jr. et al.
6,015,346 A 1/2000 Bennett
6,033,307 A 3/2000 Vancura
6,059,289 A 5/2000 Vancura
6,059,658 A 5/2000 Mangano et al.
6,062,980 A 5/2000 Luciano
6,089,976 A 7/2000 Schneider et al.
6,089,978 A 7/2000 Adams
6,102,798 A 8/2000 Bennett
6,105,962 A 8/2000 Malavazos et al.
6,113,098 A 9/2000 Adams
6,120,031 A 9/2000 Adams
6,126,542 A 10/2000 Fier
6,135,884 A 10/2000 Hedrick et al.
6,142,873 A 11/2000 Weiss et al.
6,158,741 A 12/2000 Koelling
6,159,095 A 12/2000 Frohm et al.
6,159,098 A 12/2000 Slomiany et al.
6,162,121 A 12/2000 Morro et al.
6,168,520 B1 1/2001 Baerlocher et al.
6,173,955 B1 1/2001 Perrie et al.
6,174,235 B1 1/2001 Walker et al.
6,190,255 B1 2/2001 Thomas et al.
6,224,483 B1 5/2001 Mayeroff
6,227,969 B1 5/2001 Yoseloff
6,231,442 B1 5/2001 Mayeroff
6,261,177 B1 7/2001 Bennett
6,270,411 B1 8/2001 Gura et al.
6,302,790 B1 10/2001 Brossard
6,305,686 B1 10/2001 Perrie et al.
6,309,300 B1 10/2001 Glavich
6,315,660 B1 11/2001 DeMar et al.
6,315,664 B1 11/2001 Baerlocher et al.
6,328,649 B1 12/2001 Randall et al.
6,334,814 B1 1/2002 Adams
6,336,863 B1 1/2002 Baerlocher et al.
6,338,678 B1 1/2002 Seelig et al.
6,439,995 B1 8/2002 Hughs-Baird et al.
6,450,884 B1 9/2002 Seelig et al.
6,514,141 B1 2/2003 Kaminkow et al.
6,537,152 B2 * 3/2003 Seelig et al. ..... 463/30
6,558,254 B2 5/2003 Baelocher et al.
6,572,471 B1 * 6/2003 Bennett ..... 463/16
6,599,185 B1 7/2003 Kaminkow et al.
2002/0045475 A1 4/2002 Glavich et al.
2002/0049084 A1 4/2002 Hughs-Baird et al.
2002/0072403 A1 6/2002 Baerlocher et al.
2002/0094861 A1 * 7/2002 Seelig et al. ..... 463/20
2002/0107066 A1 * 8/2002 Seelig et al. ..... 463/20
2002/0142821 A1 10/2002 Baerlocher
2002/0198038 A1 * 12/2002 Adams ..... 463/20
2003/0027628 A1 * 2/2003 Luciano ..... 463/20
2003/0073477 A1 4/2003 Baerlocher et al.

GAMING DEVICE HAVING A SELECTION-TYPE BONUS GAME THAT ACTIVATES A MECHANICAL DEVICE

PRIORITY CLAIM

This application is a continuation of and claims priority to and the benefit of U.S. patent application Ser. No. 09/960,788, filed Sep. 21, 2001, now U.S. Pat. No. 6,582,307.

CROSS REFERENCES TO RELATED APPLICATIONS

This application relates to the following co-pending commonly owned patent applications: "GAMING DEVICE HAVING A BONUS SCHEME WITH MULTIPLE SELECTION GROUPS," Ser. No. 09/656,702, "GAMING DEVICE WITH BONUS SCHEME PROVIDING INCREASED REWARD FOR SELECTING RELATED SYMBOLS," Ser. No. 09/605,023, "GAMING DEVICE HAVING MULTIPLE CHOICE LARGE AWARD BONUS SCHEME," Ser. No. 09/686,284, "GAMING DEVICE HAVING VALUE SELECTION BONUS," Ser. No. 09/684,605, "GAMING DEVICE HAVING RELATED MULTI-GAME BONUS SCHEME," Ser. No. 09/688,972, "GAMING DEVICE HAVING AN INDICATOR SELECTION WITH PROBABILITY-BASED OUTCOME BONUS SCHEME," Ser. No. 09/981,163, "GAMING DEVICE HAVING A BONUS SCHEME INCLUDING A PLURALITY OF SELECTION GROUPS WITH WIN-GROUP OUTCOMES", Ser. No. 09/981,084, "GAMING DEVICE HAVING A MULTIPLE SELECTION AND AWARD DISTRIBUTION BONUS SCHEME," Ser. No. 09/688,635, "GAMING DEVICE HAVING AN ORDERED DESIGNATION OF BONUS VALUES IN MULTIPLE VALUE SETS," Ser. No. 09/978,913, "GAMING DEVICE HAVING A BONUS SCHEME WITH MULTIPLE POTENTIAL AWARD SETS," Ser. No. 09/822,697, "GAMING DEVICE HAVING AN INDICATOR SELECTION WITH PROBABILITY-BASED OUTCOME," Ser. No. 09/990,693, "GAMING DEVICE WITH SIGNIFIED SYMBOLS," Ser. No. 09/990,484,

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly a gaming device having a bonus game wherein the gaming device enables a player to pick selections until picking a selection having a terminator, whereupon the processor of the gaming device activates a mechanical device to determine the final bonus award.

BACKGROUND OF THE INVENTION

Gaming devices, such as slot machines, having primary and secondary games are well known. One well known bonus game provides the player with an opportunity to win a bonus award by choosing one or more symbols from a group of symbols or one or more selections from a group of selections. The symbols are usually images that relate to a theme of the base game. The symbols mask awards from the player.

In one known implementation, the player picks from a group of symbols until the player picks a symbol that has been designated to terminate the bonus game, commonly referred to as a "terminator" or "pooper" and often represented by the term "COLLECT." When the player obtains a terminator, the game provides the player the award associated with the selections picked prior to picking the terminator. Examples of this type of bonus game are disclosed in U.S. Pat. No. 6,190,255 and EP 0 945 837 A2. Another example disclosed in EP 0 874 337 A1 enables the player to spin the reels of the gaming device until a non-winning combination is landed upon.

A second type of known bonus game provides a player a number of picks. A pick, for example, may be a pick from a group of masked selections, unmasked selections, or may include spinning the base game reels. An award may or may not be associated with each pick. When the player uses all of the player's picks, the accumulated awards for all of the picks are provided to the player as the final bonus award and the bonus game is terminated. An example of this type of bonus game is disclosed in EP 0 984 409 A2.

A third type of known bonus game includes a mechanical apparatus such as a wheel or reel attached to a gaming device which provides a bonus award. Similar to other bonus games, a predetermined qualifying or triggering event in the base game triggers the bonus game. One example of a mechanical device which provides a bonus award to the player is in the SLOTTO™ gaming device distributed by A.C. Coin and Slot Service Co. The SLOTTO™ gaming device includes a lottery type apparatus mounted on top of the gaming device cabinet. The apparatus includes a plurality of plastic balls inside a globe. Each ball includes an award marked thereon. The game randomly displays a ball to the player. The award marked on the displayed ball indicates the player's bonus award.

Traditional end-bonus, terminator, or pooper games determine a players final bonus award by summing selections until a terminator is obtained. Other bonus games determine the final bonus award by summing awards associated with selections picked by a player until the player uses a number of picks. Traditional mechanical bonus games display or determine the final bonus award by performing a mechanical operation absent player participation. While these final bonus award determination methods are successful, new exciting methods of determining final bonus awards are desired to provide player enjoyment, excitement and entertainment.

SUMMARY OF THE INVENTION

The present invention provides a gaming device having a bonus game wherein a mechanical device activates simultaneously with or immediately upon a player picking a selection having a terminator which ends the selection portion of the bonus game. More specifically, one embodiment of the present invention provides a processor controlled bonus game that provides a player a number of masked selections displayed on a display device. At least one and preferably a plurality of selections have an associated award and at least one selection has an associated terminator. The game enables the player to pick selections and accumulate a preliminary bonus award until picking a selection having a terminator. When the player picks a selection revealing a terminator, the processor simultaneously or immediately thereafter activates the mechanical device and after a period of time causes the mechanical device to display a modifier to the player which modifies the preliminary bonus award, thus determining the player's final bonus award. In one embodiment, the mechanical device does not include player interaction, but it should be appreciated that the mechanical device could include player interaction.

In one embodiment, the player selection stage includes a plurality of selections displayed on a display device. The selections may include any symbol, image, indicia or icon which reflects the theme of the particular game. The game enables the player to pick selections until picking a selection revealing a terminator. For each non-terminator selection picked, the game reveals an award associated with the selection. The preliminary bonus award consists of, in one embodiment, the sum of all the awards associated with selections picked by the player prior to picking the selection revealing a terminator. When a player picks a selection revealing a terminator, the processor activates the mechanical device of the bonus game.

The mechanical device could be any suitable device capable of displaying a modifier such as one or more reels, one or more wheels, or any other type of device or apparatus which is preferably attached to the cabinet of the gaming device. One embodiment of the mechanical device is similar to a lottery globe including a plurality of plastic balls having modifiers thereon. When activated, the plastic balls randomly move inside the globe and a plastic ball marked with a modifier is displayed to the player. The processor applies the modifier marked on the ball to the preliminary bonus award to determine the player's final bonus award. One advantage of this game is it enables a player to participate in a bonus game by picking selections until picking a selection having a terminator, and ultimately having a mechanical device determine the player's final bonus award.

It is therefore an advantage of the present invention to provide a gaming device having a bonus game with a terminator that activates a mechanical device to determine the player's final bonus award.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
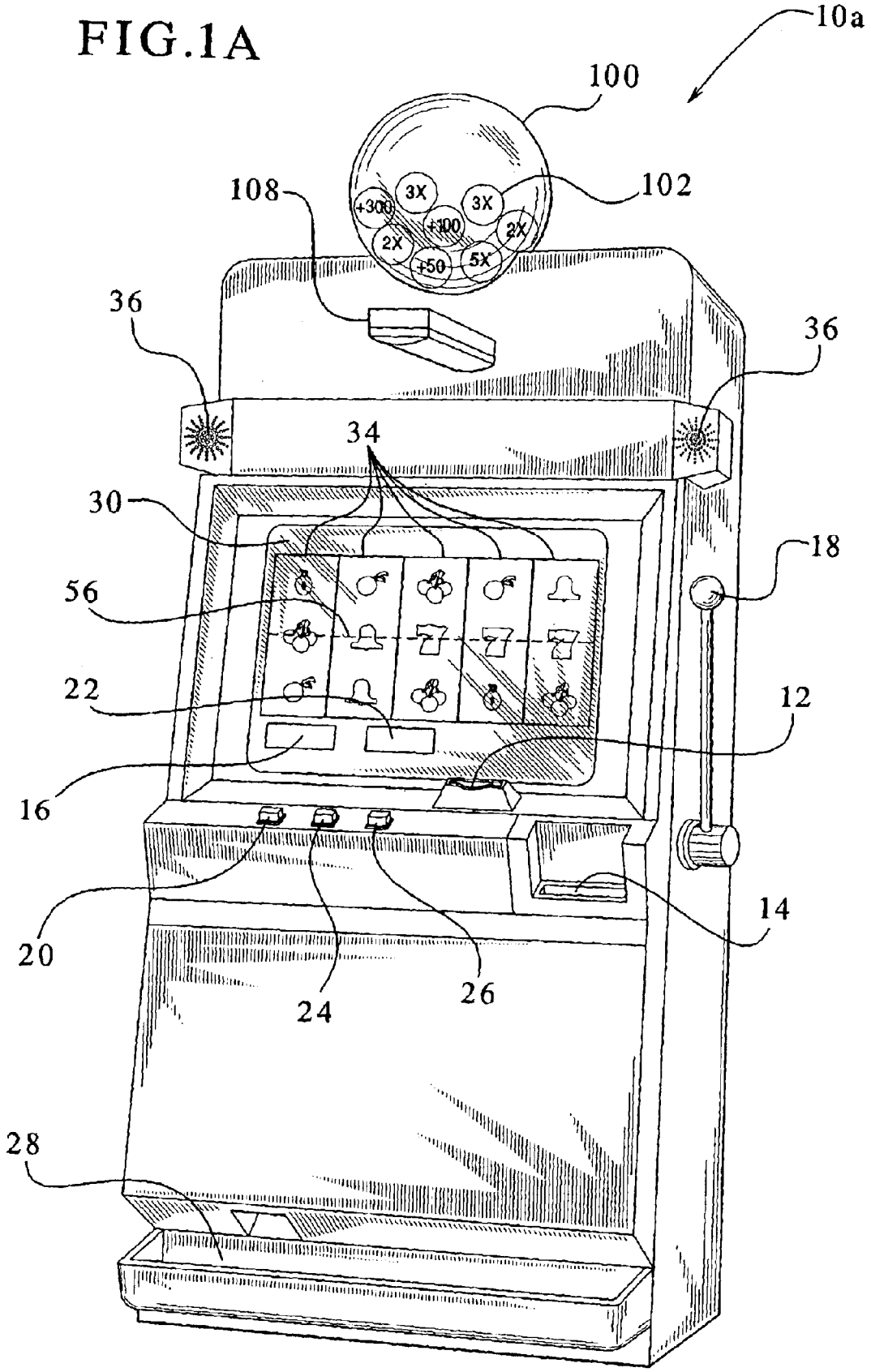
FIGS. 1A and 1B illustrate perspective views of alternative embodiments of the gaming device of the present invention.
Figure 1B:
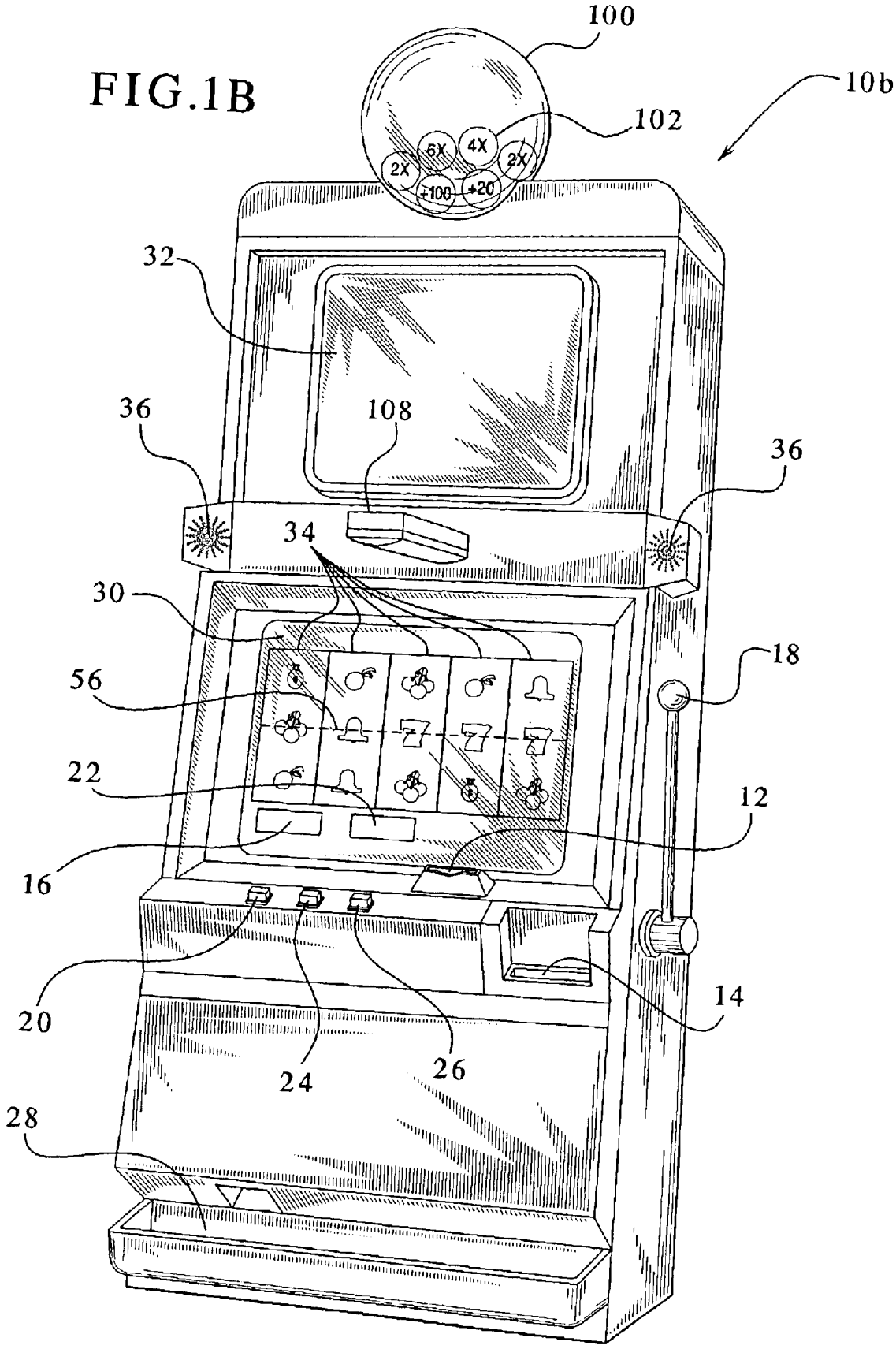

Referring now to the drawings, and in particular to FIGS. 1A and 1B, gaming device 10*a* and gaming device 10*b* illustrate two possible cabinet styles and display arrangements of the present invention and are collectively referred to herein as gaming device 10. The present invention includes the game (described below) being a stand alone game or a bonus or secondary game that coordinates with a base game. When the game of the present invention is a bonus game, gaming device 10 in one base game is a slot machine having the controls, displays and features of a conventional slot machine, wherein the player operates the gaming device while standing or sitting. Gaming device 10 also includes being a pub-style or table-top game (not shown), which a player operates while sitting.

The base games of the gaming device 10 include slot, poker, blackjack or keno, among others. The gaming device 10 also embodies any bonus triggering events, bonus games as well as any progressive game coordinating with these base games. The symbols and indicia used for any of the base or progressive games include mechanical, electrical or video symbols and indicia.

The gaming device 10 includes monetary input devices. FIGS. 1A and 1B illustrate a coin slot 12 for coins or tokens and/or a payment acceptor 14 for cash money. The payment acceptor 14 also includes other devices for accepting payment, such as readers or validators for credit cards, debit cards or smart cards, tickets, notes, etc. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. At any time during the game, a player may "cash out" by pushing a cash out button 26 to receive coins or tokens in the coin payout tray 28 or other forms of payment, such as an amount printed on a ticket or credited to a credit card, debit card or smart card. Well known ticket printing and card reading machines (not illustrated) are commercially available.

Gaming device 10 also includes one or more display devices. The embodiment shown in FIG. 1A includes a central display device 30, and the alternative embodiment shown in FIG. 1B includes a central display device 30 as well as an upper display device 32. The display devices display any visual representation or exhibition, including but not limited to movement of physical objects such as mechanical reels and wheels, dynamic lighting and video images. The display device includes any viewing surface such as glass, a video monitor or screen, a liquid crystal display or any other static or dynamic display mechanism. In a video poker, blackjack or other card gaming machine embodiment, the display device includes displaying one or more cards. In a keno embodiment, the display device includes displaying numbers.

The slot machine base game of gaming device 10 preferably displays a plurality of reels 34, preferably three to five reels 34, in mechanical or video form on one or more of the display devices. Each reel 34 displays a plurality of indicia such as bells, hearts, fruits, numbers, letters, bars or other images which preferably correspond to a theme associated with the gaming device 10. If the reels 34 are in video form, the display device displaying the video reels 34 is preferably a video monitor. Each base game, especially in the slot machine base game of the gaming device 10, includes speakers 36 for making sounds or playing music.

Figure 5:
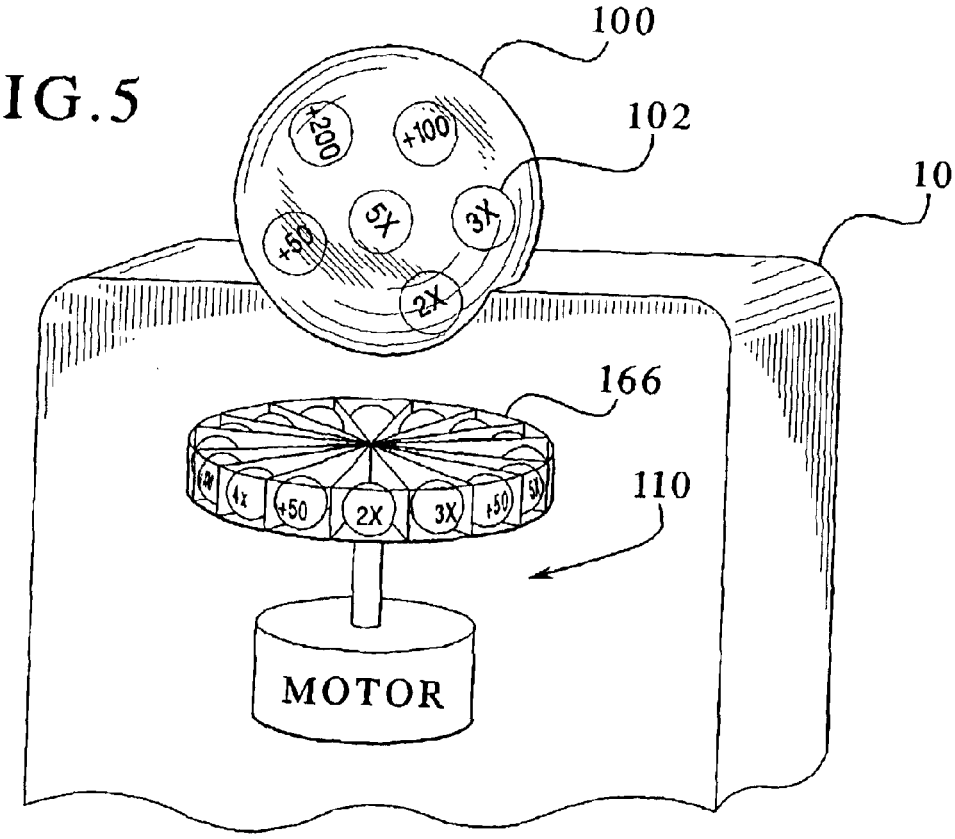
FIG. 5 is a fragmentary front elevation view of the upper portion of the gaming device of FIG. 4 with the front panel removed revealing the mechanical object dispenser.

FIGS. 1A and 1B further show gaming device 10 with a mechanical device including a spherical housing 100 containing a plurality of movable objects 102, an object window 108 for displaying a moveable object to the player, and a mechanical object dispenser 110 connected to the object window 108 (as shown in FIG. 5 and described in more detail below) for displaying an object having an award modifier marked thereon to the player as further described below. This mechanical device is adapted to be activated as part of the bonus game of the present invention as further described below. It should be appreciated that any suitable mechanical device may be used to provide an award modifier to the player and that the spherical housing, moveable object, and object dispenser are illustrated to demonstrate that the mechanical device can have multiple components.

Figure 2:
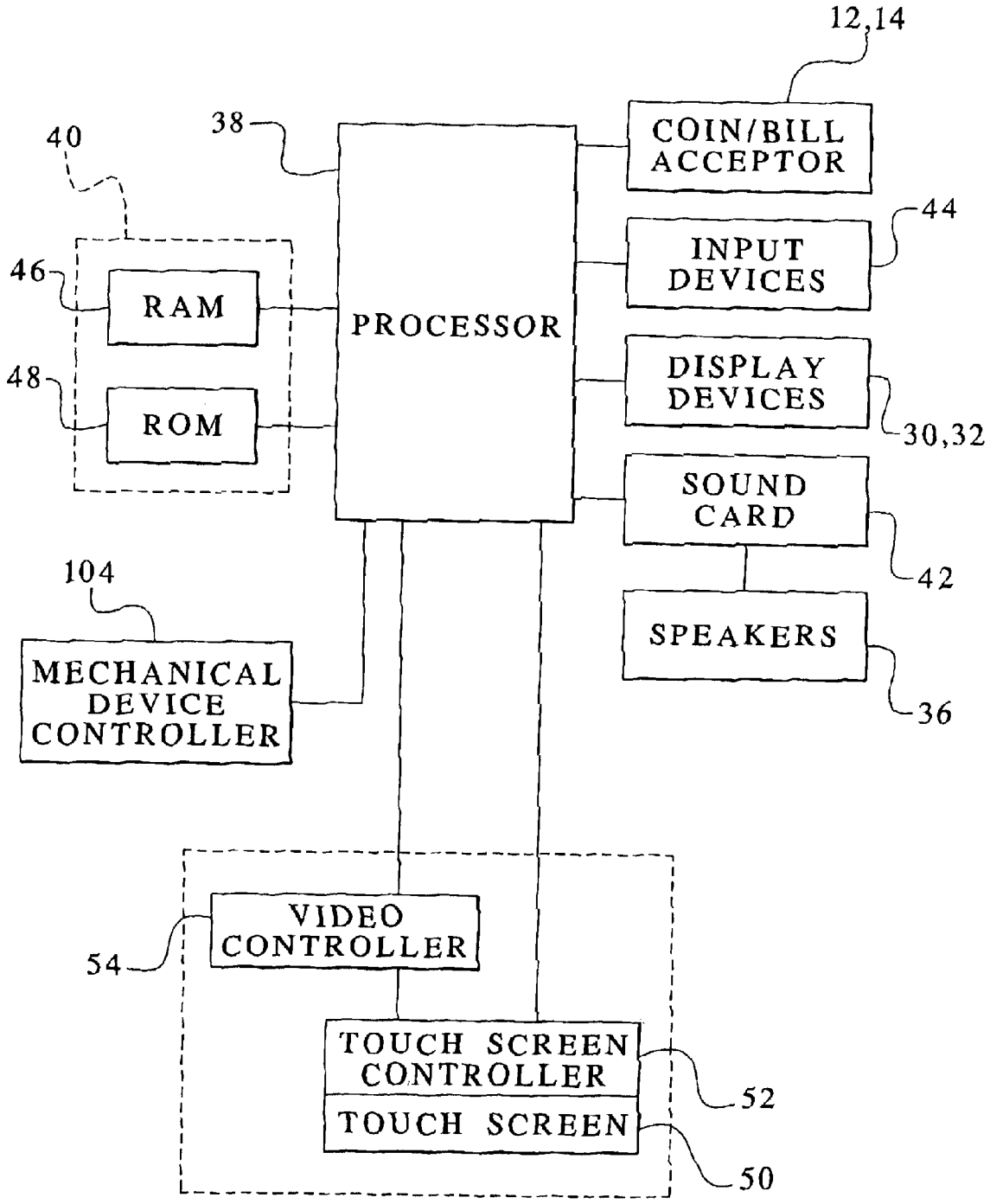
FIG. 2 is a schematic block diagram of the electronic configuration of one embodiment of the gaming device of the present invention.

Referring now to FIG. 2, a general electronic configuration of the gaming device 10 for the stand alone and bonus embodiments described above preferably includes: a processor 38; a memory device 40 for storing program code or other data; a central display device 30; an upper display device 32; a sound card 42; a plurality of speakers 36; a mechanical device controller 104; and one or more input devices 44. The processor 38 is preferably a microprocessor or micro-controller-based platform which is capable of displaying images, symbols and other indicia such as images of people, characters, places, things and faces of cards. In addition, the processor 38 communicates with said mechanical device controller 104. The memory device 40 includes random access memory (RAM) 46 for storing event data or other data generated or used during a particular game. The memory device 40 also includes read only memory (ROM) 48 for storing program code, which controls the gaming device 10 so that it plays a particular game in accordance with applicable game rules and pay tables. In the illustrated embodiment of FIGS. 1A and 1B, the mechanical device controller 104 controls a blower motor which circulates air into the container at high velocities to cause the moveable objects 102 to randomly move. The mechanical device controller 104 also controls the mechanical object dispenser 110, which includes a stepper motor which rotates a multiple chambered wheel 166 having a plurality of modifier objects 148 as illustrated in FIG. 5 and described below. This embodiment illustrates that the mechanical device employed in the present invention can include one or more mechanical sub-devices, controlled by one or more controllers, which co-act to display a modifier to the player. It should be appreciated that other suitable mechanical devices can be employed in conjunction with the present invention to display such modifier to the player.

As illustrated in FIG. 2, the player preferably uses the input devices 44 to input signals into gaming device 10. In the slot machine base game, the input devices 44 include the pull arm 18, play button 20, the bet one button 24 and the cash out button 26. A touch screen 50 and touch screen controller 52 are connected to a video controller 54 and processor 38. The terms "computer" or "controller" are used herein to refer collectively to the processor 38, the memory device 40, the sound card 42, the touch screen controller and the video controller 54.

In certain instances, it is preferable to use a touch screen 50 and an associated touch screen controller 52 instead of a conventional video monitor display device. The touch screen enables a player to input decisions into the gaming device 10 by sending a discrete signal based on the area of the touch screen 50 that the player touches or presses. As further illustrated in FIG. 2, the processor 38 connects to the coin slot 12 or payment acceptor 14, whereby the processor 38 requires a player to deposit a certain amount of money in to start the game.

It should be appreciated that although a processor 38 and memory device 40 are preferable implementations of the present invention, the present invention also includes being implemented via one or more application-specific integrated circuits (ASIC's), one or more hard-wired devices, or one or more mechanical devices (collectively referred to herein as a "processor"). Furthermore, although the processor 38 and memory device 40 preferably reside in each gaming device 10 unit, the present invention includes providing some or all of their functions at a central location such as a network server for communication to a playing station such as over a local area network (LAN), wide area network (WAN), Internet connection, microwave link, and the like.

With reference to the slot machine base game of FIGS. 1A and 1B, to operate the gaming device 10, the player inserts the appropriate amount of tokens or money in the coin slot 12 or the payment acceptor 14 and then pulls the arm 18 or pushes the play button 20. The reels 34 then begin to spin. Eventually, the reels 34 come to a stop. As long as the player has credits remaining, the player can spin the reels 34 again. Depending upon where the reels 34 stop, the player may or may not win additional credits.

In addition to winning base game credits, the gaming device 10, including any of the base games disclosed above, also includes bonus games that give players the opportunity to win credits. The gaming device 10 preferably employs a video-based display device 30 or 32 for the bonus games. The bonus games include a program that automatically begins when the player achieves a qualifying condition in the base game.

In the slot machine embodiment, the qualifying condition includes a particular symbol or symbol combination generated on a display device. As illustrated in the five reel slot game shown in FIGS. 1A and 1B, the qualifying condition includes the number seven appearing on, e.g., three adjacent reels 34 along a payline 56. It should be appreciated that the present invention includes one or more paylines, such as payline 56, wherein the paylines can be horizontal, diagonal or any combination thereof. An alternative scatter pay qualifying condition includes the number seven appearing on, e.g., three adjacent reels 34 but not necessarily along a payline 56, appearing on any different set of reels 34 three times or appearing anywhere on the display device the necessary number of times.

Bonus Game

Generally, when the base game of the present invention achieves a triggering event, the gaming device initiates a bonus game and enables the player to pick selections from a plurality of selections until picking a selection revealing a terminator. The game displays a plurality or group of selections on the display device for the player to pick from. In one embodiment, the display device of the present invention includes a selector such as a touch screen which enables the player to pick selections by physically touching the touch screen in the area of a selection. The selector alternatively can be one or more mechanical devices connected to the controller. In the preferred embodiment, the selections are images displayed by the display device. In a simple embodiment, there are two selections. An award is associated with one selection and a terminator is associated with the other selection. A preferred embodiment includes a plurality of selections, at least one terminator associated with at least one of the selections, and an award associated with each of the other selections. It should be appreciated that an award may only be associated with one or more selections and a terminator may be associated with more than one selection.

In one embodiment, each time the game is initiated the processor randomly assigns awards to the selections. Alternatively, the processor may assign the awards to the order of picks the player makes, wherein the specific selections picked by the player do not determine the awards. Further, the bonus game initiation process includes randomly determining the association of the terminator(s). The game may thus physically or temporally associate the terminator. Physical association is accomplished by randomly determining which selection(s) of the group of selections, when picked, reveals a terminator. The processor accomplishes temporal association by randomly determining a number of picks the player gets before revealing the terminator. In one embodiment, to ensure that the player receives a bonus award, the terminator is not revealed with the first pick.

Figure 3:
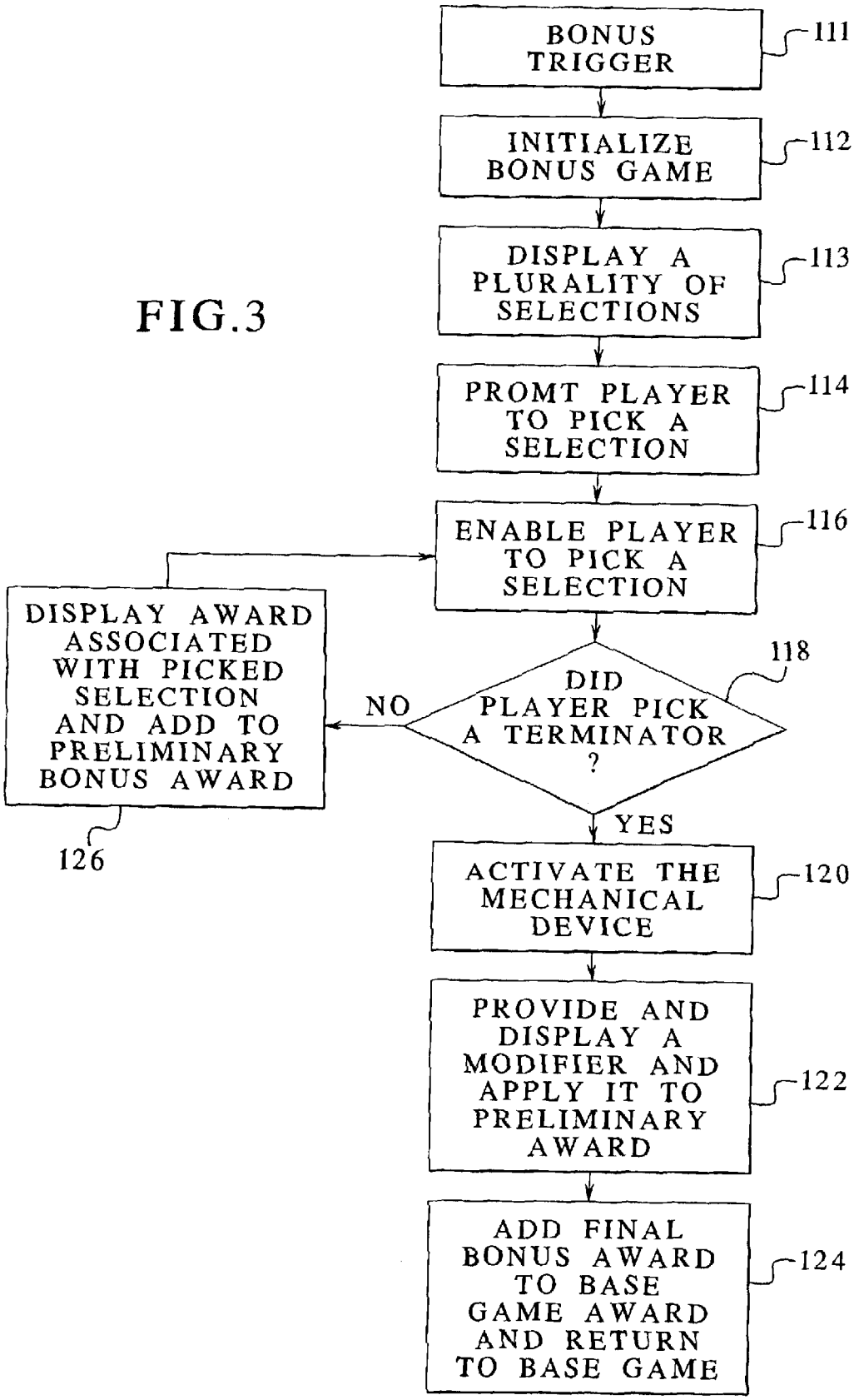
FIG. 3 is a flow diagram illustrating one method of the present invention.

Referring now to FIG. 3, a triggering event occurs in the base game which triggers the bonus game as indicated by block 111. After triggering the bonus game, the game initializes the player selection stage as indicated by block 112, displays a plurality or group of selections on the display device 30 or 32 as indicated by block 113, and prompts the player to pick a selection as indicated by block 114. The game enables the player to pick one selection from the group of selections as indicated by block 116. The game then reveals whether the player picked a terminator selection as indicated by diamond 118. In another embodiment, the processor randomly predetermines how may picks the player gets before revealing the terminator, thus the condition of block 118 would be whether or not the pick is the player's last pick.

If the picked selection does not reveal a terminator, the game displays an award and adds it to the preliminary bonus award, as indicated by block 126. The above process is repeated until a player picks a selection revealing a terminator. Each award associated with each selection is randomly determined by the processor, either during initialization of the bonus game or simultaneously with the player's selection. In one embodiment, the award values increase as the player advances through the bonus game without picking a selection revealing a terminator.

When a selection reveals a terminator, the processor simultaneously with revealing the terminator or immediately thereafter activates a mechanical device, as indicated by block 120. In one alternative embodiment, the gaming device includes a clock for creating a delay period or count-down between the time the player picks a selection revealing a terminator and the mechanical device activates. This may add excitement to the game. In either embodiment however, the mechanical device after a period of time of performing its mechanical function displays or provides a modifier to the player adapted by the processor to modify the preliminary bonus award to determine the player's final bonus award as indicated by block 122. Finally, the processor adds the final bonus award to the player's base game award (or player's credits) and enables the player to continue with the base game as indicated in block 124. Although the modifier may be any suitable value or award, preferably it is one of a plurality of values or multipliers.

Figure 4:
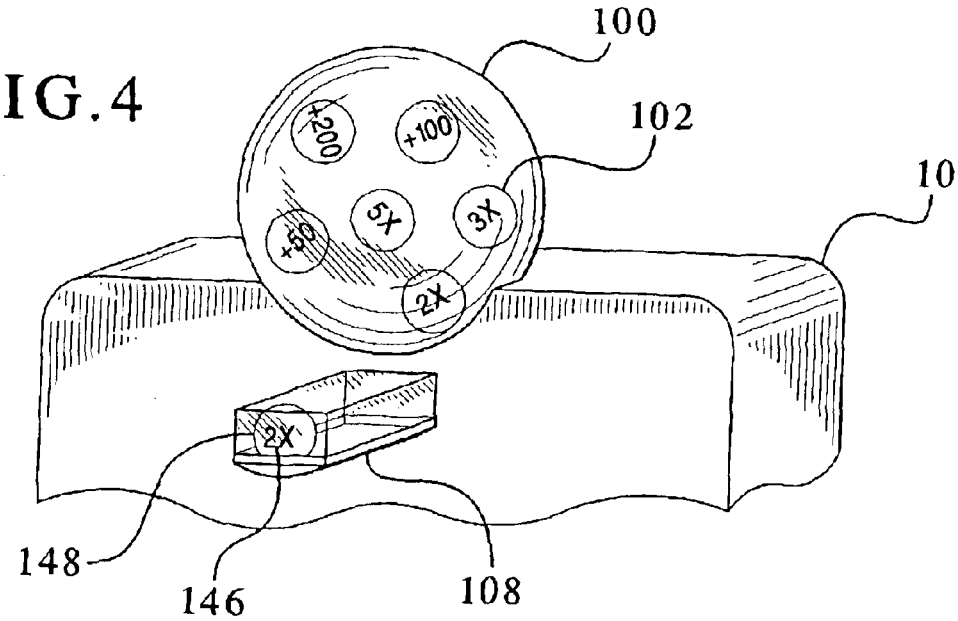
FIG. 4 is a fragmentary front elevation view of the upper portion of a gaming device having a mechanical device in the form of a container including a plurality of moveable objects and a window for displaying a modifier to the player.

Referring now to FIG. 4, the primary embodiment of the mechanical device of the present invention is shown mounted in the top portion of the housing of a gaming device 10. This mechanical device is a lotto-type device and includes a glass or plastic transparent spherical housing 100 attached to the cabinet of the gaming device 10. The housing contains a plurality of moveable objects 102 which are lightweight plastic balls. Each of the lightweight plastic balls have modifiers marked thereon and are readable by the player. This mechanical device includes an air blower for circulating air in the housing 100 causing the moveable objects 102 to randomly move.

The mechanical device illustrated also includes an object window 108 adapted to display a modifier object 148 from an object dispensing device 110. FIG. 5 illustrates one embodiment of an object dispensing device 110 adapted to randomly display modifier objects 148 in the object window 108 for the player to view. Each modifier object 148 has a modifier value 146 thereon adapted by the processor to modify the preliminary bonus award to determine the player's final bonus award. After the player views the modifier object 148, the object dispensing device 110 removes the modifier object 108 from the object window 108.

Figure 6A:
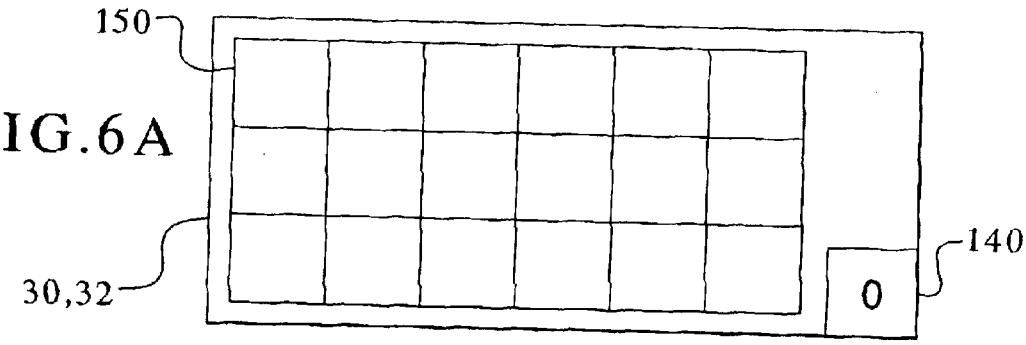
FIGS. 6A, 6B, 6C, and 6D are diagrammatic views of a display on a display device of one embodiment of the present invention having a plurality of selections masking a plurality of awards and one terminator.
Figure 6B:
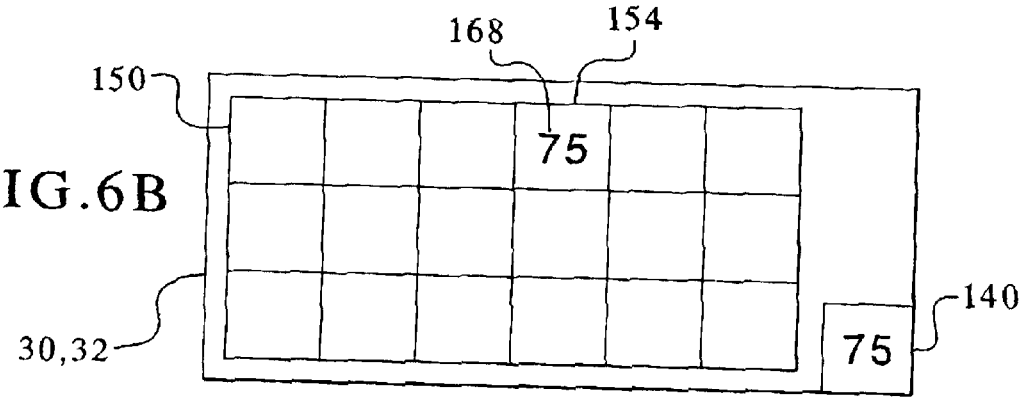

FIGS. 6A to 6D and 7A to 7C illustrate an example of the primary embodiment of the present invention. More specifically, FIGS. 6A to 6D show the display device 30 or 32 displaying a group of selections 150 and an award meter 140. The game prompts the player to pick a selection from the group of selections 150. FIG. 6B illustrates that the first selection 154 picked by the player does not reveal a terminator and it has an associated award 168 of seventy-five credits. The game displays the award 168 and adds it to the award meter 140. Selection 154 does not reveal a terminator and the game prompts the player to pick again.

Figure 6C:
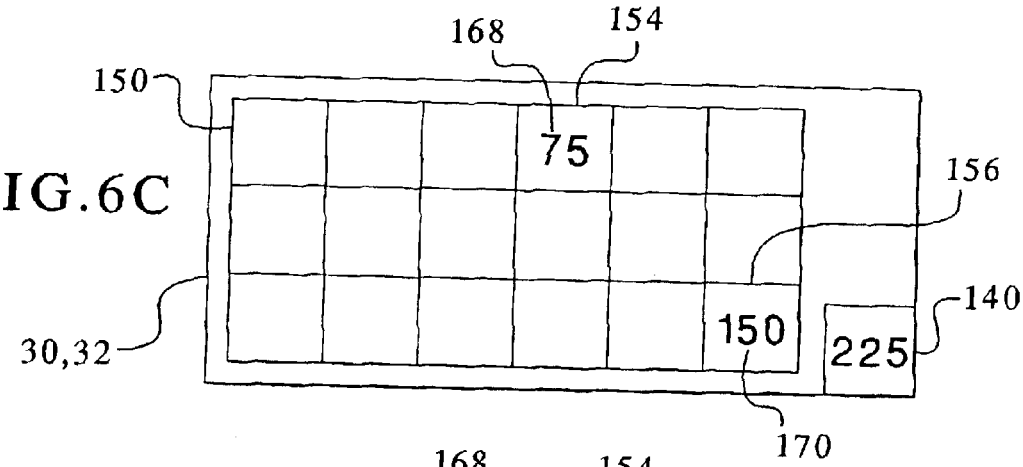

FIG. 6C illustrates that the second selection 156 picked by the player is not the terminator. The game displays the selection's 156 associated award 170 of one-hundred fifty credits and adds it to the award meter 140. The game then prompts the player to pick again.

Figure 6D:
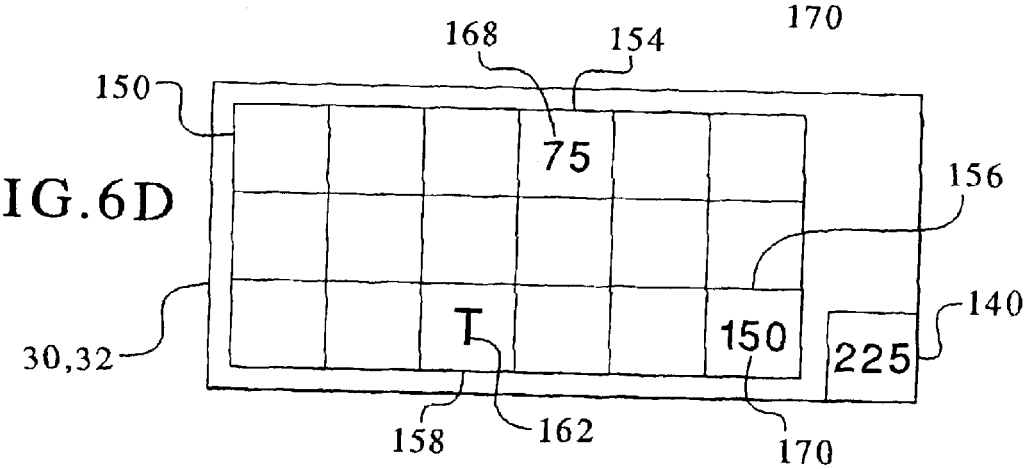

FIG. 6D reveals that the third selection 158 picked by the player reveals the terminator, represented by a terminator symbol 162. In one embodiment, there is no award associated with the terminator. The processor activates the mechanical device immediately subsequent to revealing the terminator symbol 162.

Figure 7A:
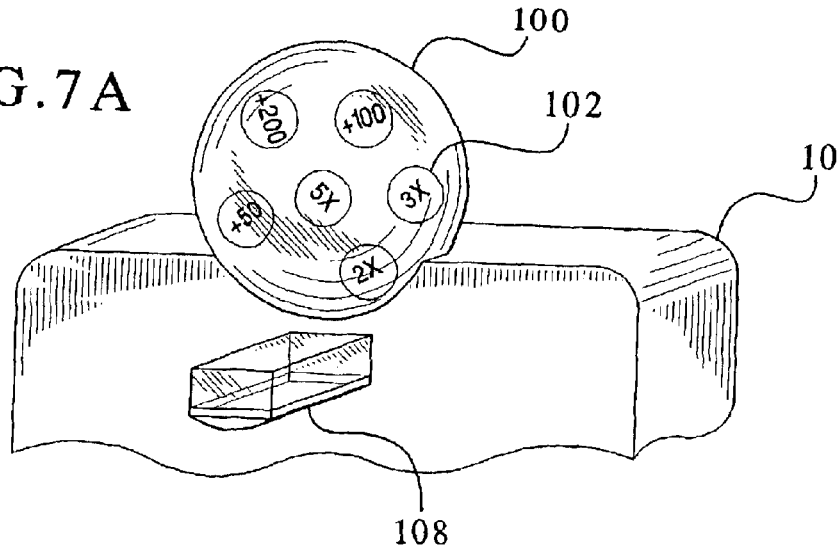
FIGS. 7A, 7B, and 7C are fragmentary front elevations of the upper portion of a gaming device having a mechanical device in the form of a container including a plurality of moveable objects, wherein the three figures together represent the cycle of the mechanical device portion of one embodiment of the present invention.
Figure 7B:
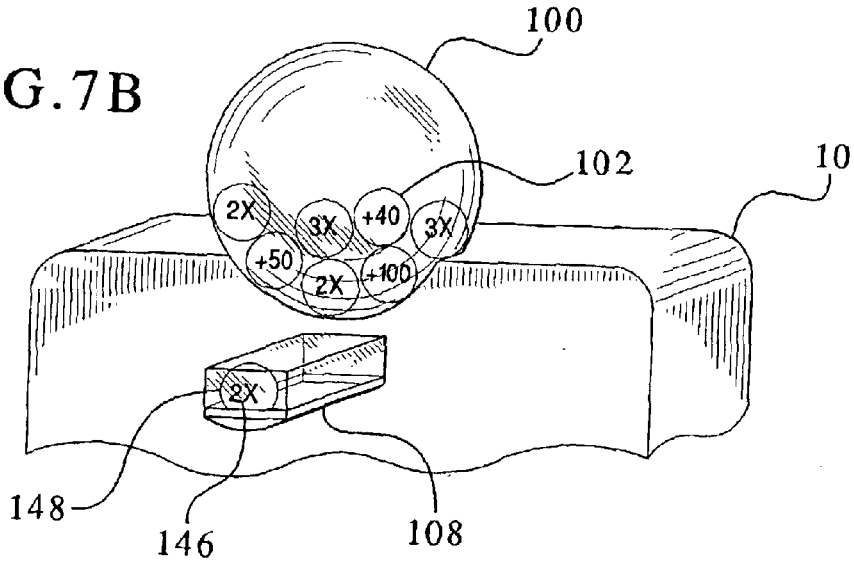
Figure 7C:
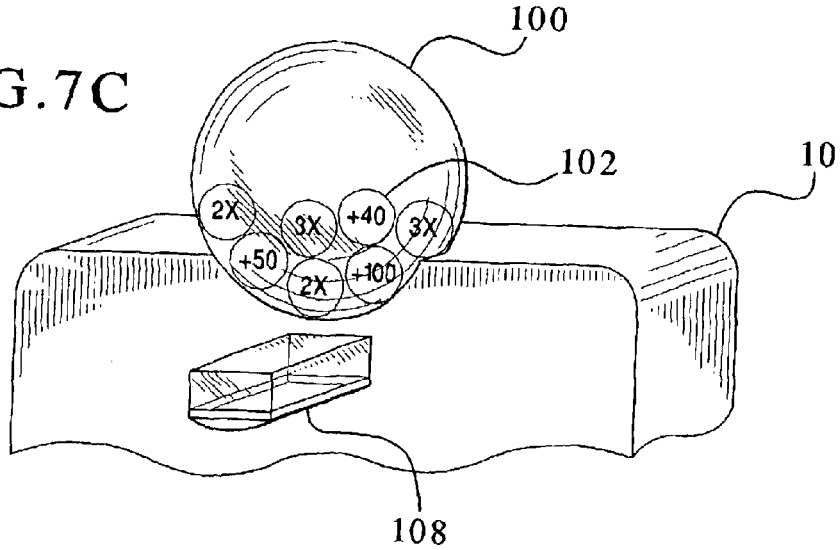

FIGS. 7A, 7B, and 7C illustrate one embodiment of the mechanical device activated subsequent to revealing the terminator symbol 162. FIG. 7A illustrates the fluctuation of the moveable objects 102 within the transparent spherical container 100. FIG. 7B illustrates the mechanical object dispenser displaying a modifier object 148 having a modifier 146 marked thereon to the player in the object window 108. FIG. 7C illustrates that the mechanical object dispenser retracts the modifier object 148 from the object window 108 and the moveable objects 102 in the container 100 settle, indicating the termination of the bonus game.

Figure 8:
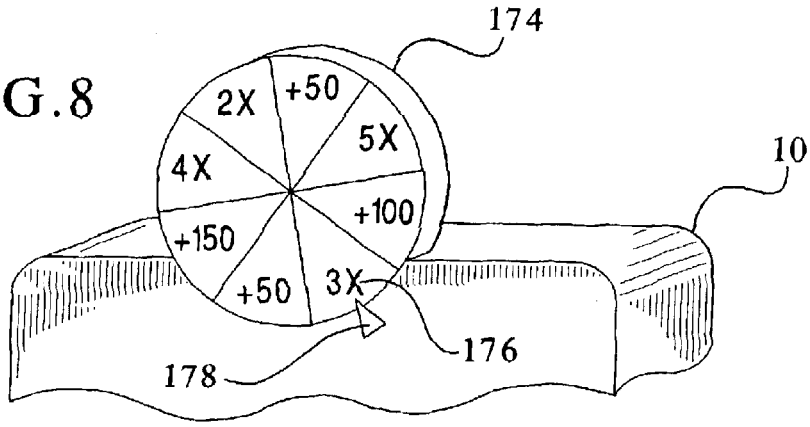
FIG. 8 is a fragmentary front elevation view of the upper portion of an alternative embodiment of the gaming device, wherein the mechanical device is a wheel.

As indicated above, the mechanical device may be any suitable mechanical device which displays or indicates the plurality of possible modifiers to the player. FIG. 8 illustrates an alternative embodiment of the gaming device having a mechanical device which includes a modifier wheel 174 attached to the top of the cabinet of the gaming device 10. The processor immediately activates or spins the modifier wheel 174 for a period of time upon a player picking a selection revealing a terminator. The modifier wheel 174 slows to a stop and an indicator 178 indicates to the player the player's modifier "3×" indicated by the numeral 176. The processor applies the modifier to the preliminary bonus award to determine the player's final bonus award.

Alternative Embodiments

It should be appreciated that in one alternative embodiment of the present invention, the processor does not need to activate the mechanical device every time a player picks a selection revealing a terminator. In one embodiment, the processor activates the mechanical device when the player picks a terminator selection according to a predetermined probability stored in the gaming device's memory. In another embodiment, activation of the mechanical device depends upon the number of picks the player has made prior to picking a selection revealing a terminator, (i.e., less than a maximum number or greater than a minimum number). It should also be appreciated that activation of the mechanical device may depend upon the amount of the player's preliminary bonus award prior to the player picking a selection revealing a terminator, (i.e., less than a maximum amount or greater than a minimum amount).

Further, a bonus game having multiple terminators may only activate the mechanical device upon the player picking a particular terminator or each terminator may activate the mechanical device one or more times. More specifically, the primary embodiment may include two terminators, T1 and T2. When a player picks a selection revealing T1, the mechanical device activates once and one modifier is displayed to the player. The processor applies this modifier to the preliminary bonus award to determine the player's final bonus award. However, when a player picks a selection revealing T2, the mechanical device activates twice, each time displaying a modifier to the player. The processor applies the first modifier to the preliminary bonus award and the second modifier to the already modified preliminary bonus award to determine the player's final bonus award.

Figure 9A:
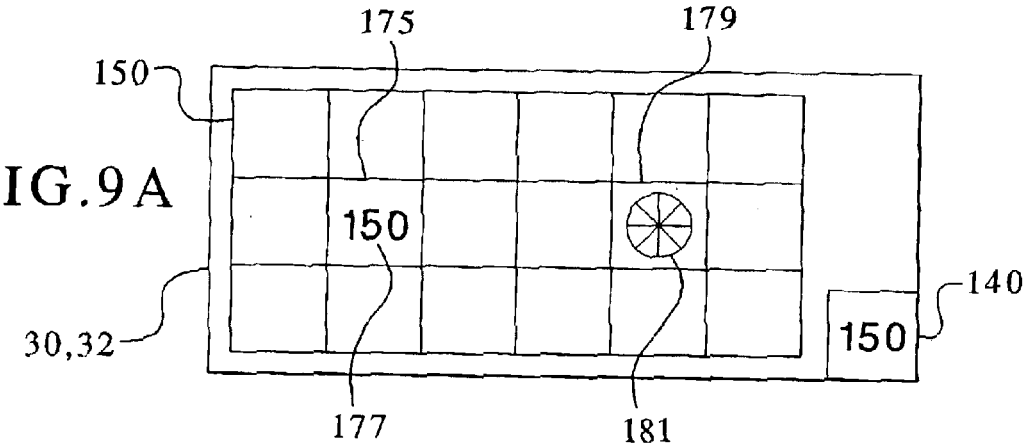
FIG. 9A is a diagrammatic view of a display on a display device having a plurality of selections masking a plurality of awards and multiple terminators, wherein one award and one terminator are revealed to the player.
Figure 9B:
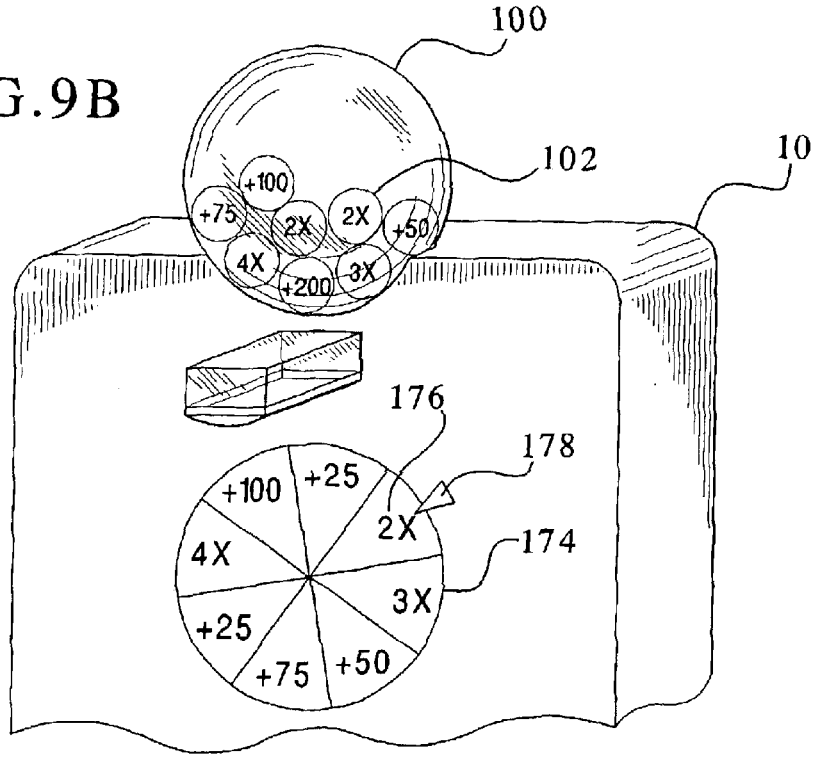
FIG. 9B is a fragmentary front elevation view of the upper portion of an alternative embodiment of the gaming device having two mechanical devices.

It should also be appreciated that other embodiments may include multiple mechanical devices. For example, one embodiment includes one modifier wheel and one lottery-type globe. In this embodiment, the game includes one or more terminators, wherein a picked selection revealing a terminator activates one or both of the mechanical devices. FIGS. 9A and 9B illustrate one embodiment, wherein a specific terminator activates a lottery-type device 100 and another terminator activates the modifier wheel 174. FIG. 9A illustrates that the player's first selection reveals an award 177 of one hundred fifty credits. The award meter 140 displays this award. FIG. 9A further illustrates that the player's second selection 179 reveals a terminator symbol 181. Since this embodiment includes two different mechanical devices, the revealed terminator indicates a particular device, in this case the modifier wheel 174. FIG. 9B illustrates that the modifier wheel 174 stopped on the modifier "2×" indicated by the numeral 176 as indicated by the indicator 178. The processor is adapted to modify the player's preliminary bonus award, which is one hundred fifty in this example, by "2×" to determine the player's final bonus award.

In another embodiment, the gaming device includes a mechanical selector connected to the processor such that when the player picks a selection revealing a terminator, the game enables the player to use the selector to pick which mechanical device to activate. In a similar embodiment, after the player picks a selection revealing a terminator the game requires said player to use said selector to activate said mechanical device.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is hereby claimed as follows:

1. A gaming device operable under control of at least one processor, the gaming device comprising:

a cabinet;

a display device supported by the cabinet and controlled by the processor;

a selection game having a plurality of selections displayed by the display device;

a first set of outcomes associated with the selections;

a plurality of different types of terminators associated with a plurality of the selections, wherein at least one of said different terminators types is a designated terminator and each of said terminators cause a terminating event to occur in said selection game when picked;

a selector in communication with the processor for enabling a player to pick one or more of said selections including one of the selections with the associated terminator;

a mechanical device supported by the cabinet and controlled by the processor, said mechanical device selectively activated by the processor after the player picks the selection with the associated designated terminator; and a second set of outcomes, wherein the mechanical device is operable to indicate one of the outcomes in the second set to the player.

2. The gaming device of claim 1, wherein the first set of outcomes includes at least one award.

3. The gaming device of claim 1, wherein the first set of outcomes includes an outcome selected from the group consisting of an award, a bonus award, a value, a preliminary bonus award and a base game award.

4. The gaming device of claim 1, wherein the second set of outcomes includes a modification of at least one of the outcomes in the first set of outcomes.

5. The gaming device of claim 1, wherein the second set of outcomes includes an outcome selected from the group consisting of a modification of at least one of the outcomes in the first set of outcomes, an award, a bonus award, a value and a final bonus award.

6. The gaming device of claim 1, wherein the game includes a bonus game.

7. A gaming device operable under control of at least one processor, the gaming device comprising:

a cabinet;

a display device supported by the housing and controlled by the processor;

a plurality of selections displayed by the display device;

a plurality of different types of terminators associated with a plurality of the selections, wherein at least one of said terminators is a designated terminator;

a selector in communication with the processor for enabling a player to pick the selections until picking one of the selections reveals one of the terminators;

a first set of outcomes associated with the selections, wherein each of said outcomes associated with one of the selections provides the player with a preliminary outcome;

a mechanical device supported by the cabinet and controlled by the processor, the mechanical device selectively activated by the processor after the player's picking of the selections reveals the designated terminator; and a second set of outcomes associated with the mechanical device, wherein the processor is operable to utilize the mechanical device to selectively indicate at least one of the outcomes in the second set and operable to apply said indicated outcome to the preliminary outcome to determine a final outcome for the player.

8. The gaming device of claim 7, wherein the terminators each includes a termination event, said termination event selected from the group consisting of the player making a quantity of picks, reaching a maximum award amount, reaching a minimum award amount, a randomly generated event, a probability-based generated event, and a player-selected event.

9. The gaming device of claim 7, wherein the first set of outcomes includes at least one award.

10. The gaming device of claim 7, wherein the first set of outcomes includes an outcome selected from the group consisting of an award, a bonus award, a value, a preliminary award, a preliminary bonus award and a base game award.

11. The gaming device of claim 7, wherein the preliminary outcome includes at least one preliminary award.

12. The gaming device of claim 7, wherein the second set of outcomes includes a modification of at least one of the outcomes in the first set of outcomes.

13. The gaming device of claim 7, wherein the second set of outcomes includes an outcome selected from the group consisting of a modification of at least one of the outcomes in the first set of outcomes, an award, a bonus award, a value and a final bonus award.

14. The gaming device of claim 7, wherein the game includes a bonus game.

15. A gaming device operable under control of at least one processor, the gaming device comprising:

a cabinet;

a display device supported by the cabinet and controlled by the processor;

a game having a plurality of selections displayed by the display device;

a quantity of picks provided by the processor to a player for picking a plurality of the selections;

a first set of outcomes associated with the picks of the player;

a terminator associated with at least one of the selections;

a selector in communication with the processor for enabling the player to pick a plurality of the selections until using all of the player's picks or picking a selection associated with the terminator;

a mechanical device supported by the cabinet and controlled by the processor, the mechanical device selectively activated by the processor after the player uses the player's last pick or picks one of the selections associated with the terminator;

a second set of outcomes, wherein the mechanical device is adapted to indicate to the player one of the outcomes in the second set; and a total outcome provided to the player based on said first set of outcomes and said second set of outcomes.

16. The gaming device of claim 15, wherein the first set of outcomes includes at least one award.

17. The gaming device of claim 15, wherein the first set of outcomes includes an outcome selected from the group consisting of an award, a bonus award, a value, a preliminary award, a preliminary bonus award and a base game award.

18. The gaming device of claim 15, wherein the second set of outcomes includes a modification of at least one of the outcomes in the first set of outcomes.

19. The gaming device of claim 15, wherein the second set of outcomes includes an outcome selected from the group consisting of a modification of at least one of the outcomes in the first set of outcomes, an award, a bonus award, a value and a final bonus award.

20. The gaming device of claim 15, wherein the terminator includes a symbol associated with a termination event, the termination event selected from the group consisting of reaching maximum award amount, reaching a minimum award amount, a randomly generated event, a probability-based generated event, and a player-selected event.

21. The gaming device of claim 15, wherein the game includes a bonus game.

22. A gaming device operable under control of at least one processor, the gaming device comprising:

a cabinet;

a plurality of player selectable symbols;

a first set of outcomes associated with the player selectable symbols, at least one of said outcomes including a termination outcome;

a display device supported by the cabinet and controlled by the processor, the display device operable to display the player selectable symbols;

a second set of outcomes;

a mechanical device supported by the cabinet and controlled by the processor, the mechanical device selectively operable to indicate to a player at least one of the outcomes in the second set after the termination outcome occurs; and a final outcome provided to the player based on the first set of outcomes and the second set of outcomes.

23. The gaming device of claim 22, wherein the first set of outcomes includes at least one outcome selected from the group consisting of an award, a bonus award, a value, a preliminary award, a preliminary bonus award and a base game award.

24. Then gaming device of claim 22, wherein the termination outcome includes a termination event selected from the group consisting of the player making a quantity of picks of the player selectable symbols, reaching a maximum award amount, reaching a minimum award amount, a randomly generated event, a probability-based generated event, and a player-selected event.

25. The gaming device of claim 22, which includes a graphical representation of the first set of outcomes displayed by the display device, wherein the graphical representation includes a graphical representation selected from the group consisting of a text message, a numerical message, a value, an award, a symbol and a terminator symbol.

26. The gaming device of claim 22, wherein the second set of game outcomes includes at least one outcome selected from the group consisting of a modification of any one of the outcomes in the first set of outcomes, an award, a value, a bonus award and a final bonus award.

27. A method of operating a gaming device, the method comprising the steps of:

(a) providing a selection game;

(b) displaying a plurality of selections;

(c) providing a first set of outcomes, including a plurality of different types of terminators, associated with the selections, wherein at least one of said plurality of different terminators is a designated terminator and each of said terminators causes a terminating event to occur in said selection game when picked;

(d) enabling a player to pick a plurality of the selections until picking one of the selections associated with one of the terminators;

(e) providing a second set of outcomes; and (f) if the player picks the selections associated with the designated terminator:

(i) selectively causing a mechanical device to indicate one of the outcomes in the second set to the player; and (ii) providing the player said indicated outcome.

28. The method of claim 27, wherein the step of providing a game includes the step of providing a bonus game.

29. The method of claim 27, wherein the step of providing a first set of outcomes includes the step of providing at least one award.

30. The method of claim 27, wherein the step of providing a first set of outcomes includes the step of providing an outcome selected from the group consisting of an award, a bonus award, a value, a preliminary bonus award and a base game award.

31. The method claim 27, wherein the step of providing the second set of outcomes includes the step of providing a modification of at least one of the outcomes in the first set of outcomes.

32. The method of claim 27, wherein the step of providing the second set of outcomes includes the step of providing an outcome selected from the group consisting of a modification of at least one of the outcomes in the first set of outcomes, an award, a bonus award, a value and a final bonus award.

33. A method for operating a gaming device comprising the steps of:

(a) displaying a plurality of symbols to a player;

(b) associating a first outcome and a termination outcome with the symbols;

(c) enabling the player to select at least one of the symbols;

(d) causing the first outcome to occur;

(e) displaying the first outcome to the player;

(f) causing the termination outcome to occur;

(g) selectively causing a mechanical device to indicate to the player a second outcome after the termination outcome occurs; and (h) providing the second outcome to the player.

34. The method of claim 33, wherein the step of causing the first outcome to occur includes the step of causing an outcome to occur which is selected from the group consisting of an award, a bonus award, a value, a preliminary award, a preliminary bonus award and a base game award.

35. The method of claim 33, wherein the step of causing the termination outcome to occur includes the step of causing an outcome to occur which is selected from the group consisting of the player making a quantity of picks of the player selectable symbols, reaching a maximum award amount, reaching a minimum award amount, a randomly generated event and a probability-based generated event.

36. The method of claim 33, wherein the step of displaying the first outcome includes the step of providing a graphical representation selected from the group consisting of a text message, a numerical message, a value, an award, a symbol and a terminator symbol.

37. The method of claim 33, wherein the step of providing the second outcome to occur includes the step of causing an outcome to occur which is selected from the group consisting of a modification of the first outcome, an award, a value, a bonus award and a final bonus award.

38. The method of claim 33, which includes the step of graphically representing the termination outcome to the player.

39. The method of claim 27, wherein said steps are provided to the player through a data network.

40. The method of claim 39, wherein the data network is an internet.

41. The method of claim 33, wherein said steps are provided to the player through a data network.

42. The method of claim 41, wherein the data network is an internet.

43. The gaming device of claim 1, wherein a terminator symbol is associated with said terminator and said terminator symbol is displayed after the player picks the selection associated with the terminator.

44. The gaming device of claim 7, wherein a terminator symbol is associated with said terminator and said terminator symbol is revealed after the player picks the selection associated with the terminator.

45. The gaming device of claim 15, wherein a terminator symbol is associated with said terminator and said terminator symbol is displayed after the player picks the selection associated with the terminator.

46. The gaming device of claim 22, wherein a terminator symbol is associated with said termination outcome and said terminator symbol is displayed after the player picks the selection associated with the termination outcome.

47. The method of claim 27, which includes the step of displaying a terminator symbol when the player picks one of the selections associated with the terminator.

48. The method of claim 33, which includes the step of displaying the termination outcome to the player.

49. A gaming device operable under control of at least one processor, the gaming device comprising:

a cabinet;

a display device supported by the cabinet and controlled by the processor;

a plurality of selections adapted to be displayed by the display device;

a first plurality of outcomes associated with a plurality of said selections;

a first terminator associated with at least one of said selections;

a different second terminator associated with at least one of said selections;

a selector in communication with the processor for enabling a player to pick the selections until picking one of the selections revealing one of the terminators;

a first mechanical device supported by the cabinet and controlled by the processor, said first mechanical device activated by the processor after the player picks the selection associated with the first terminator;

a second plurality of outcomes, wherein said first mechanical device is operable to indicate one of the outcomes in the second plurality of outcomes to the player;

a second mechanical device supported by the cabinet and controlled by the processor, said second mechanical device activated by the processor after the player picks the selection associated with the different second terminator; and a third plurality of outcomes, wherein said second mechanical device is operable to indicate one of the outcomes in the third plurality of outcomes to the player.

50. A gaming device operable under control of at least one processor, the gaming device comprising:

a cabinet;

a display device supported by the cabinet and controlled by the processor;

a game having a plurality of selections displayed by the display device;

a first set of outcomes associated with the selections;

a plurality of different terminators associated with a plurality of the selections, wherein at least one of said plurality of different terminators a designated terminator;

a selector in communication with the processor for enabling a player to pick one or more of said selections including the selection with one of the associated terminators;

a mechanical device supported by the cabinet and controlled by the processor, said mechanical device activated by the processor after the player picks the selection with the associated designated terminator; and a second set of outcomes, wherein the mechanical device is operable to indicate one of the outcomes in the second set to the player.

51. A gaming device operable under control of at least one processor, the gaming device comprising:

a cabinet;

a display device supported by the cabinet and controlled by the processor;

a game having a plurality of selections displayed by the display device;

a first set of outcomes associated with the selections;

a terminator associated with one of the selections;

a selector in communication with the processor for enabling a player to pick one or more of said selections including the selection with the associated terminator;

a mechanical device supported by the cabinet and controlled by the processor, said mechanical device selectively activated by the processor after the player picks the selection with the associated terminator; and a second set of outcomes, wherein the mechanical device is operable to indicate one of the outcomes in the second set to the player.

52. The gaming device of claim 51, wherein said mechanical device is selectively activated by the processor based on a predetermined probability.

53. The gaming device of claim 51, wherein said mechanical device is selectively activated by the processor based on the number selections the player picks prior to picking the selection with the associated terminator.

* * * * *

UNITED STATES PATENT AND TRADEMARK OFFICE

CERTIFICATE OF CORRECTION

PATENT NO. : 6,843,722 B2
APPLICATION NO. : 10/459755
DATED : January 18, 2005
INVENTOR(S) : Bayard S. Webb It is certified that error appears in the above-identified patent and that said Letters Patent is hereby corrected as shown below:

In Claim 1, column 10, line 45, changed “terminators” to --terminator--.

In Claim 27, column 13, line 40, changed “selections” to --selection--.

In Claim 29, column 13, line 48, changed “a first set” to --the first set--.

In Claim 30, column 13, line 52, changed “a first set” to --the first set--.

In Claim 37, column 14, line 32, changed “occur” to --the player--.

In Claim 50, column 16, line 3, changed “a” to --is a--.

Signed and Sealed this

Twentieth Day of November, 2007

JON W. DUDAS
*Director of the United States Patent and Trademark Office*